US011279155B2

(12) United States Patent
Ohmura

(10) Patent No.: US 11,279,155 B2
(45) Date of Patent: Mar. 22, 2022

(54) CONVEYANCE CONTROL DEVICE AND IMAGE FORMING APPARATUS

(71) Applicant: Yuuji Ohmura, Ibaraki (JP)

(72) Inventor: Yuuji Ohmura, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/812,515

(22) Filed: Mar. 9, 2020

(65) Prior Publication Data

US 2020/0290378 A1 Sep. 17, 2020

(30) Foreign Application Priority Data

Mar. 12, 2019 (JP) ..... JP2019-045084

(51) Int. Cl.
*B41J 29/38* (2006.01)
*B41J 15/04* (2006.01)

(52) U.S. Cl.
CPC ..... *B41J 15/04* (2013.01)

(58) Field of Classification Search
None
See application file for complete search history.

(56) References Cited

U.S. PATENT DOCUMENTS

2010/0110134 A1 5/2010 Ohmura et al.
2012/0160117 A1* 6/2012 Ohmura ..... B41J 11/0005 101/228
2013/0201267 A1 8/2013 Ohmura et al.
2014/0375741 A1 12/2014 Ohmura et al.
2015/0166282 A1* 6/2015 Shirane ..... B65H 1/04 358/1.15
2016/0068360 A1* 3/2016 Devitt ..... B65H 23/32 226/190

(Continued)

FOREIGN PATENT DOCUMENTS

JP 2001-033229 2/2001
JP 2015-199552 11/2015

(Continued)

*Primary Examiner* — Erica S Lin
*Assistant Examiner* — Tracey M McMillion
(74) *Attorney, Agent, or Firm* — Harness, Dickey & Pierce, P.L.C.

(57) ABSTRACT

A conveyance control device is configured to control conveyance of a sheet-shaped recording medium onto which a liquid is discharged by a liquid discharge device. The conveyance control device includes a conveyance driving roller, a non-contact conveyor, and processing circuitry. The conveyance driving roller is configured to control a conveyance speed of the recording medium. The non-contact conveyor includes a non-contact conveyance roller that constitutes part of a conveyance path of the recording medium. The non-contact conveyance roller has an outer peripheral surface in a non-contact state with the recording medium during conveyance of the recording medium. The processing circuitry is configured to control at least one of an operation of the conveyance driving roller and an operation of the non-contact conveyance roller such that a speed of the outer peripheral surface of the non-contact conveyance roller becomes a prescribed speed faster than the conveyance speed of the recording medium.

11 Claims, 8 Drawing Sheets

(56) References Cited

U.S. PATENT DOCUMENTS

| | | | | |
|---|---|---|---|---|
| 2016/0263913 | A1 | 9/2016 | Akatsu et al. | |
| 2017/0165981 | A1 | 6/2017 | Kuwabara et al. | |
| 2018/0339437 | A1* | 11/2018 | Patterson | B29C 43/48 |
| 2019/0047298 | A1* | 2/2019 | Hashimoto | B41J 11/002 |

FOREIGN PATENT DOCUMENTS

| | | |
|---|---|---|
| JP | 2015-224128 | 12/2015 |
| JP | 2019-031019 | 2/2019 |

* cited by examiner

CONVEYANCE CONTROL DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-045084, filed on Mar. 12, 2019, in the Japan Patent Office, the entire disclosure of which is hereby incorporated by reference herein.

BACKGROUND

Technical Field

Aspects of the present disclosure relate to a conveyance control device and an image forming apparatus.

Discussion of the Background Art

There is known an image forming apparatus that forms an image by attaching an image forming material such as liquid ink to a recording medium (hereinafter, referred to as a "web") made of a long sheet material. The image forming apparatus includes a conveyance device for conveying a web to an image former, and a conveyance control device for controlling operations of the conveyance device.

There is also known an image forming apparatus including a drying device for drying liquid ink attached to a web. The drying device may be a separate device (separate housing) from the image forming apparatus.

A positional relationship between the web and the image former that discharges the liquid ink onto the web as a recording medium (in particular, a distance between the liquid discharger and an image forming surface) is an important factor in forming a high-quality image. Therefore, it is necessary to apply appropriate tension for supporting the web being conveyed so that this positional relationship is maintained in an appropriate state. If the proper tension is not applied, the image quality is affected, and the web being conveyed may be stuck in a conveyance path (paper jam).

SUMMARY

In an aspect of the present disclosure, there is provided a conveyance control device configured to control conveyance of a sheet-shaped recording medium onto which a liquid is discharged by a liquid discharge device. The conveyance control device includes a conveyance driving roller, a non-contact conveyor, and processing circuitry. The conveyance driving roller is configured to control a conveyance speed of the recording medium. The non-contact conveyor includes a non-contact conveyance roller that constitutes part of a conveyance path of the recording medium. The non-contact conveyance roller has an outer peripheral surface in a non-contact state with the recording medium during conveyance of the recording medium. The processing circuitry is configured to control at least one of an operation of the conveyance driving roller and an operation of the non-contact conveyance roller such that a speed of the outer peripheral surface of the non-contact conveyance roller becomes a prescribed speed faster than the conveyance speed of the recording medium.

In another aspect of the present disclosure, there is provided an image forming apparatus that includes the conveyance control device configured to control the conveyance of the recording medium and the liquid discharge device configured to discharge the liquid onto the recording medium conveyed by the conveyance control device, to form an image on the recording medium.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
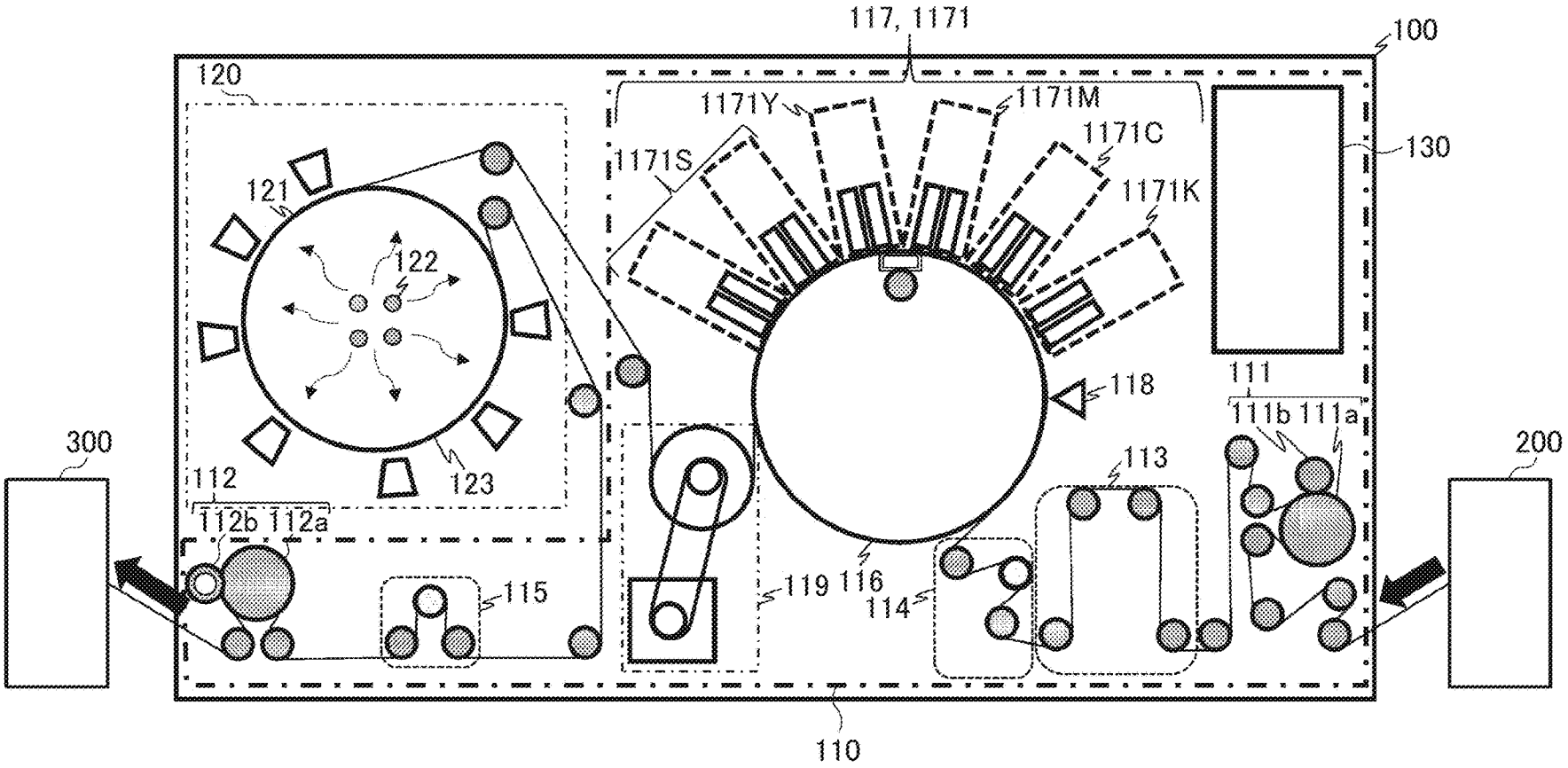
FIG. 1 is a configuration diagram illustrating an example of a printer that is an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

First Embodiment of Image Forming Apparatus

Hereinafter, a conveyance control device and an image forming apparatus according to embodiments of the present disclosure are described with reference to the drawings. FIG. 1 is a schematic diagram illustrating a configuration of a printer 100 that is an embodiment of an image forming apparatus. The printer 100 is an inkjet-type image forming apparatus, and forms an image by discharging liquid ink as an image forming material onto a web W which is a long and sheet-like recording medium. Therefore, the printer 100 is also a liquid discharge device.

The printer 100 includes an image forming device 110 and a drier 120. The printer 100 also includes a controller 130 that controls the overall operations of the image forming device 110 and the drier 120. The controller 130 constitutes part of a conveyance control device according to an embodiment of the present disclosure.

Further, the printer 100 is connected to an unwinding device 200 that holds the long web W in a rolled form and supplies the web W on the upstream side in the conveyance direction of the web W, and is also connected to a winding device 300 that winds the web W having undergone image formation and drying on the downstream side in the conveyance direction.

The unwinding device 200 is connected to an inlet A of the printer 100, and loads the web W into the image forming device 110 via the inlet A. Further, the winding device 300 is connected to an outlet B of the printer 100, unloads the web W on which an image is formed by the image forming device 110 and is dried by the drier 120 via the outlet B, and rewinds and collects the web W. In addition to the winding device 300, a post-processing device that performs a cutting process, a laminating process, and the like can be connected to a stage following the printer 100.

In order to configure a part of the web W conveyance route (conveyance path), the printer 100 has a plurality of idle rollers. The web W is hung over the idle rollers to support a conveyance state (conveyance posture). The conveyance path inside the printer 100 includes rollers included in a non-contact conveyor 119 described later.

Configuration of Image Forming Device

The image forming device 110 includes a first conveyance driving roller pair 111, a second conveyance driving roller pair 112, a meandering controller 113, a first tension detector 114, and a second tension detector 115, a platen drum 116, an IJ head device 117, a web movement amount detection sensor 118, and a non-contact conveyor 119.

The first conveyance driving roller pair 111 includes a first driving roller 111*a* connected to a driving source driven by control of the controller 130, and a first pinch roller 111*b* that sandwiches the web W with the first driving roller 111*a*. The web W is conveyed in a predetermined direction (a direction of thick black arrow illustrated in FIG. 1) by driving of the first conveyance driving roller pair 111. The first conveyance driving roller pair 111 is arranged at the uppermost stream in the conveyance direction of the web W.

The second conveyance driving roller pair 112 includes a second driving roller 112*a* connected to a driving source driven by the control of the controller 130, and a second pinch roller 112*b* that sandwiches the web W with the second driving roller 112*a*. The web W is conveyed in a predetermined direction (a direction of thick black arrow illustrated in FIG. 1) by driving of the second conveyance driving roller pair 112. The second conveyance driving roller pair 112 is arranged at the most downstream in the conveyance direction of the web W.

The first conveyance driving roller pair 111 and the second conveyance driving roller pair 112 constitute conveyance driving rollers that control a conveyance speed of the web W. The operations of the first conveyance driving roller pair 111 and the second conveyance driving roller pair 112 are controlled by the controller 130. That is, the controller 130 controls the operations of the first conveyance driving roller pair 111 and the second conveyance driving roller pair 112 such that the conveyance speed of the web W becomes a predetermined speed.

The meandering controller 113 adjusts the position of the conveyed web W in a width direction to a specified position. The controller 130 also performs an adjustment operation in the meandering controller 113.

The first tension detector 114 includes a pressure detection mechanism such as a load cell in a bearing to detect tension of the web W. The web W is hung on a tension roller constituting the first tension detector 114. The first tension detector 114 detects the tension of the web W by detecting a force applied to the web W by the tension roller, and notifies the controller 130 of the detected tension. The controller 130 determines whether the magnitude of the notified tension is appropriate, and controls the first tension detector 114 to increase or decrease the tension of the web W based on the determination result.

The first conveyance driving roller pair 111, the meandering controller 113, and the first tension detector 114 constitute a paper conveyor. After passing through the paper conveyor, the web W is conveyed while being wound around the platen drum 116.

The second tension detector 115 includes a pressure detection mechanism such as a load cell in a bearing, and detects the tension of the web W that is dried by the drier 120 and discharged. The web W is wound around a tension roller that constitutes the second tension detector 115. The second tension detector 115 detects the tension of the web W by detecting the force applied to the tension roller, and notifies the controller 130 of the detected tension. The controller 130 determines whether the notified tension is appropriate, and controls each of the conveyance driving rollers to increase or decrease the tension of the web W by the second tension detector 115 based on the determination result.

The platen drum 116 rotates at a predetermined speed with the web W wound around its outer periphery. The rotation of the platen drum 116 is controlled by the controller 130. The conveyance speed of the web W is determined by the rotation speed of the platen drum 116.

The tension applied to the web W is determined by the controller 130 controlling the rotation amount of the first driving roller 111*a* such that the tension detected by the first tension detector 114 becomes a preset value. That is, the controller 130 constitutes a conveyance speed control device that controls the conveyance speed of the web W.

The IJ head device 117 is disposed above the platen drum 116 as seen in the vertical direction. The IJ head device 117 is formed by disposing and fixing a plurality of IJ heads 1171 along the outer periphery of the platen drum 116 in the width direction of the web W. The IJ head device 117 corresponds to a liquid discharge unit.

The IJ head device 117 includes an IJ head array 1171K for discharging K ink, an IJ head array 1171C for discharging C ink, an IJ head array 1171M for discharging M ink, an IJ head array 1171Y for discharging Y ink, and a special ink, and an IJ head array 1171S for discharging special ink. The K ink is black ink. The C ink is cyan ink. The M ink is magenta ink. The special ink is ink used to further improve the quality of a formed image in clear colors or the like.

The controller 130 also controls the ink discharge operation of the IJ head device 117. The controller 130 assigns a discharge operation to each of the IJ heads 1171 based on image formation target data input from the outside. This discharge operation is controlled to be performed at an optimal timing in relation to the web W conveyed at a predetermined conveyance speed.

The web movement amount detection sensor 118 is a sensor for detecting the movement amount of the web W on the surface of the platen drum 116. The detection signal from the web movement amount detection sensor 118 is sent to the controller 130 that calculates the movement amount of the web W. Based on the movement amount calculated here, the timing of the discharge operation in the IJ head device 117 is controlled. The controller 130 may calculate a web speed Ws described later based on the result of detection by the web movement amount detection sensor 118.

The non-contact conveyor 119 is one of the components of the conveyance path, and forms the conveyance path in which the web W with an image forming surface (printing surface) undried is to be conveyed from the platen drum 116. Thus, the non-contact conveyor 119 is structured to convey the web W in a predetermined direction without contacting the undried image forming surface. Therefore, the non-contact conveyor 119 has a function of allowing non-contact conveyance of the web W. The image forming surface corresponds to a specific part of the web W that has passed through the IJ head device 117 as a liquid discharge unit. The non-contact conveyor 119 is disposed to convey the web W with the specific part insufficiently dried to the drier 120 so as not to contact with the components constituting the conveyance path. The non-contact conveyor 119 will be described later in detail.

Configuration of Drier

The drier 120 includes a drying drum 121, a heater 122, and air nozzles 123. The drying drum 121 includes the heater 122 therein. The heater 122 is, for example, a halogen lamp or the like, and heats the web W wound around the drying drum 121 from a printing back surface (opposite to the image forming surface). The plurality of air nozzles 123 is arranged on the outer periphery of the drying drum 121 along the drying drum 121. The air nozzles 123 blow air or hot air directly onto the printing surface (image forming surface). The heat applied to the drier 120 configured as described above evaporates the liquid on the web W to dry the image forming surface.

Depending on the physical properties of the ink and the productivity required of the drier 120, for the facilitation of drying, the drier 120 may be an IR heater or the like that dries the image forming surface by heat radiation.

In order to dry the liquid ink by the drier 120, it is necessary to set a heating temperature and a heating time according to the physical properties of the liquid ink and the web W as a print medium. However, in the printer 100 that forms an image at a high speed, it is necessary to provide a long heating conveyance distance according to the conveyance speed in order to secure the heating time. In that case, the drier 120 becomes large, whereby the printer 100 tends to upsize.

Example of Detailed Configuration of Non-Contact Conveyor

Figure 2:
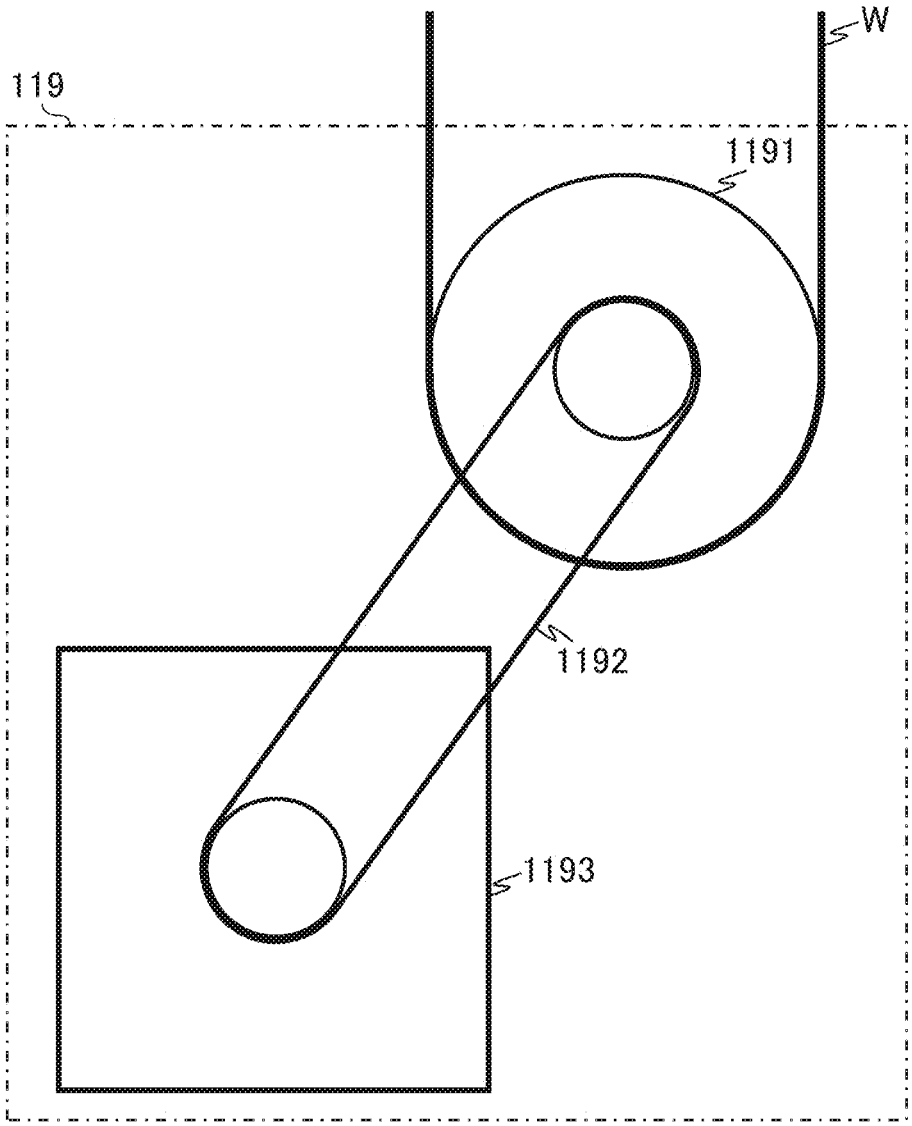
FIG. 2 is a configuration diagram illustrating an example of a non-contact conveyor provided in the printer.

A configuration of the non-contact conveyor 119 will be described in detail. FIG. 2 is a schematic diagram illustrating the configuration of the non-contact conveyor 119. As illustrated in FIG. 2, the non-contact conveyor 119 includes a non-contact conveyance roller 1191, a timing belt 1192, and a non-contact conveyance roller driving source 1193.

The timing belt 1192 is wound around between an axis of the non-contact conveyance roller 1191 and a rotation axis of the non-contact conveyance roller driving source 1193. That is, the non-contact conveyance roller 1191 and the non-contact conveyance roller driving source 1193 are connected by the timing belt 1192. When the non-contact conveyance roller driving source 1193 operates to rotate the rotation shaft, the timing belt 1192 is turned and transmitted by the driving force to the shaft of the non-contact conveyance roller 1191, so that the non-contact conveyance roller 1191 rotates. The controller 130 controls the rotation speed, the rotation start, the rotation stop, and the acceleration and deceleration of the rotation speed of the non-contact conveyance roller driving source 1193. The non-contact conveyance roller driving source 1193 is a motive power source that supplies motive power necessary for the operation of the non-contact conveyance roller 1191. A detailed configuration of the controller 130 will be described later.

When the operations of the first conveyance driving roller pair 111 and the second conveyance driving roller pair 112 are controlled to increase the conveyance speed of the web W or increase the rotation speed of the non-contact conveyance roller 1191, the surrounding air is taken into between the surface of the web W and the outer peripheral surface of the non-contact conveyance roller 1191. This forms a gap (air layer) between the web W and the outer peripheral surface of the non-contact conveyance roller 1191. The web W is supported by the air layer without being in contact with the non-contact conveyance roller 1191. That is, after the formation of the image, the conveyance path can be formed while supporting the web W without contact with the image forming surface of the web W on which the liquid ink is undried.

As for the amount (floating amount) by which the web W floats from the outer peripheral surface of the non-contact conveyance roller 1191, whether the web W will contact or not contact (enter a non-contact state) with the outer peripheral surface of the non-contact conveyance roller 1191 is determined by a magnitude relationship between "the sum of surface roughness" obtained by combining the roughness of the surface of the web W and the roughness of the outer peripheral surface of the non-contact conveyance roller 1191 and the floating amount of the web W.

The factors relating to whether the web W will float from the non-contact conveyance roller 1191 and to the floating amount are the conveyance speed of the web W, the speed of the outer peripheral surface of the non-contact conveyance roller 1191, the surface roughness of the web W, the surface roughness of the non-contact conveyance roller 1191, the tension of the web W, the air permeability of the web W (hardness of passing air), the viscosity of the air around the web W and the non-contact conveyance roller 1191, and the like. That is, whether the web W will float from the outer peripheral surface of the non-contact conveyance roller 1191 is determined by these factors.

Here, it is assumed that the non-contact conveyance roller 1191 is a roller that does not receive the driving force from the non-contact conveyance roller driving source 1193 but rotates following the web W. In this case, when the conveyance of the web W is started and the speed of the surface of the web W (web surface speed) is accelerated, the non-contact conveyance roller 1191 is rotated by friction with the web W, and the speed of the outer peripheral surface (the outer peripheral speed of the roller) is also increased. In the process of this acceleration, when the non-contact conveyance roller 1191 takes in the surrounding air, the web W gradually floats from the outer peripheral surface of the non-contact conveyance roller 1191. When the torque transmitted between the web W and the non-contact conveyance roller 1191 becomes equal to or less than the rotational load of the non-contact conveyance roller 1191, the non-contact conveyance roller 1191 which is a driven roller will no longer rotate.

In the above assumptions, factors in determining the speed at which the non-contact conveyance roller 1191 shifts from the rotating state to the non-rotating state include the friction coefficient between the two in addition to the ones described above. When the speed of the web W further increases, the floating amount increases to maintain the non-contact state.

It is assumed that the web surface speed at which a desired floating amount is obtained is "100 mpm". This web surface speed is also the speed of the web W passing below the IJ head device 117 during image formation. That is, when a job (print job) in which the image forming speed does not reach 100 mpm is executed, the image forming surface of the web W after image formation comes into contact with the outer peripheral surface of the non-contact conveyance roller 1191. Therefore, the formed image becomes disturbed.

Therefore, if the web surface speed does not reach the speed at which the desired floating amount can be obtained, or in accordance with the foregoing example, if the image forming speed is slow and the web surface speed does not reach 100 mpm, the non-contact conveyor 119 according to the present embodiment allows the formation of the conveyance path while supporting the web W without contact with the non-contact conveyance roller 1191. This will be described in more detail based on the foregoing example. When the web surface speed does not reach 100 mpm, the non-contact conveyance roller 1191 included in the non-contact conveyor 119 is rotated. At this time, the rotation speed of the non-contact conveyance roller 1191 is set such that the speed of the outer peripheral surface of the roller is higher than the web surface speed. The rotation speed of the non-contact conveyance roller 1191 is controlled by the controller 130. At this time, the controller 130 controls the difference between the speed of the outer peripheral surface of the non-contact conveyance roller 1191 and the surface speed of the web W to be a value at which a desired floating amount is obtained.

Controlling in this way allows the air to be intentionally taken into between the non-contact conveyance roller 1191 and the web W, thereby to obtain a desired floating amount. This increases the floating amount of the web W so that the web W can be conveyed without contacting the image forming surface in the configuration in which the conveyance path is formed even when the conveyance speed of the web W (the web surface speed) is low.

In order to obtain a desired floating amount, the controller 130 controls the operations of at least either the non-contact conveyance roller 1191 or the first conveyance driving roller pair 111 and the second conveyance driving roller pair 112 so that the speed of the outer peripheral surface of the non-contact conveyance roller 1191 becomes a prescribed speed higher than the web surface speed. That is, the controller 130 controls the conveyance speed of the web W by controlling the operations of the first conveyance driving roller pair 111 and the second conveyance driving roller pair 112. This forms the relationship with the speed of the outer peripheral surface of the non-contact conveyance roller 1191 as described above, thereby making it possible to obtain a desired floating amount. The controller 130 also controls the operation of the non-contact conveyance roller driving source 1193 to control the speed of the outer peripheral surface of the non-contact conveyance roller 1191, thereby forming the relationship with the conveyance speed of the web W as described above and making it possible to obtain a desired floating amount.

Method of Detecting Floating Amount

Figure 3:
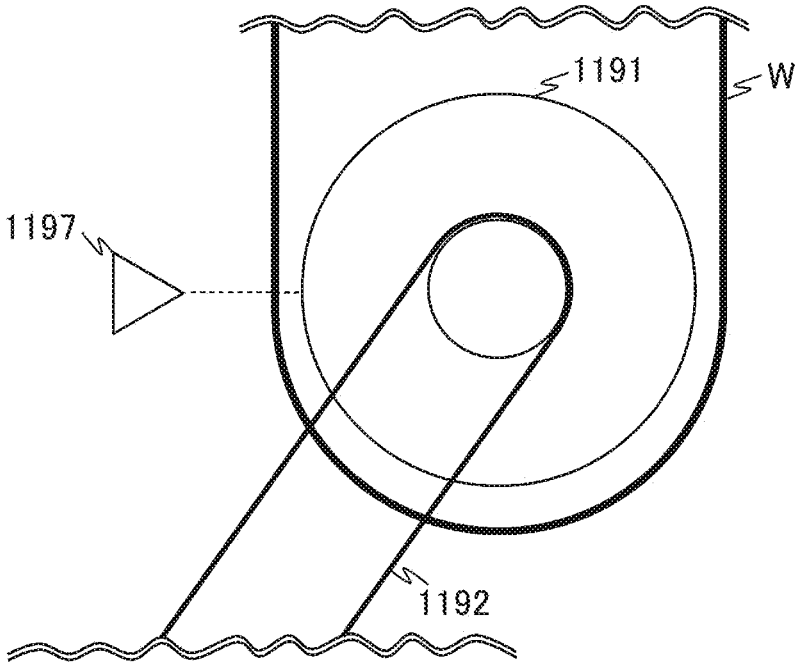
FIG. 3 is a diagram illustrating a detailed configuration of the non-contact conveyor.

Next, a floating amount detection unit included in the non-contact conveyor 119 will be described with reference to FIG. 3. The non-contact conveyor 119 is provided with a floating amount detection sensor 1197 which constitutes the floating amount detection unit for detecting the floating amount of the web W wound around the non-contact conveyance roller 1191. The floating amount detection sensor 1197 is a sensor that detects the floating amount of the web W from the outer peripheral surface of the non-contact conveyance roller 1191, and is a distance sensor using laser or ultrasonic waves. The controller 130 performs controls based on the detection operation of the floating amount detection sensor 1197 and the determination on the detection result. The floating amount detection sensor 1197 and the controller 130 constitute a gap measurement unit.

There is a plurality of methods for calculating the floating amount. For example, with the web W not wound around the non-contact conveyance roller 1191, the floating amount detection sensor 1197 measures a distance to the outer peripheral surface of the non-contact conveyance roller 1191, thereby to acquire a reference distance. Thereafter, with the web W wound around the non-contact conveyance roller 1191, the floating amount detection sensor 1197 measures the distance to the web W and subtracts the total sum of the reference distance and the thickness of the web W from the measurement value, thereby to calculate the floating amount.

In addition, when the web W does not float near a position of entry into the non-contact conveyance roller 1191 or a position of exit from the non-contact conveyance roller 1191, the floating amount detection sensor 1197 acquires the reference distance to the surface of the web W (to be the image forming surface), and calculates the floating amount by the difference from the distance to the surface of the web W at the timing for calculating the floating amount. The method for calculating the floating amount by the floating amount detection sensor 1197 is not limited to these, and the same effect can be obtained by acceleration or deceleration control of the rotation speed of the non-contact conveyance roller 1191 according to the calculated floating amount.

Since there are various factors related to the floating amount, depending on the conditions defined by these factors, the actual floating amount may be large or small with respect to the desired floating amount for supporting the web W in a non-contact manner. When the floating amount is small, that is, when the distance between the image recording surface of the web W during conveyance and the outer peripheral surface of the non-contact conveyance roller 1191 is short, the undried ink image may come into contact with the non-contact conveyance roller 1191 so that the image becomes disturbed, In addition, when the floating amount is large, that is, when the distance between the image recording surface of the web W during conveyance and the outer peripheral surface of the non-contact conveyance roller 1191 is long, an outer peripheral speed AGs of the non-contact conveyance roller 1191 will become higher than necessary. Thus, unnecessary load may be applied to parts related to driving of the roller to accelerate wear and deterioration.

Therefore, when the floating amount of the web W detected by the floating amount detection sensor 1197 is smaller than a predetermined value, the rotation speed of the non-contact conveyance roller driving source 1193 is controlled to increase the outer peripheral speed AGs of the non-contact conveyance roller 1191. Conversely, when the floating amount of the web W detected by the floating amount detection sensor 1197 is larger than a predetermined value, the rotation speed of the non-contact conveyance roller driving source 1193 is controlled to decrease the outer peripheral speed AGs of the non-contact conveyance roller 1191.

By controlling as described above, it is possible to prevent image disturbance by the contact of the undried ink image with the non-contact conveyance roller 1191 and to suppress wear and deterioration of the components related to driving of the non-contact conveyance roller 1191. This makes it possible to suppress the cost of replacement parts and reduce downtime related to replacement of parts.

Embodiment of Conveyance Control Device

Figure 4:
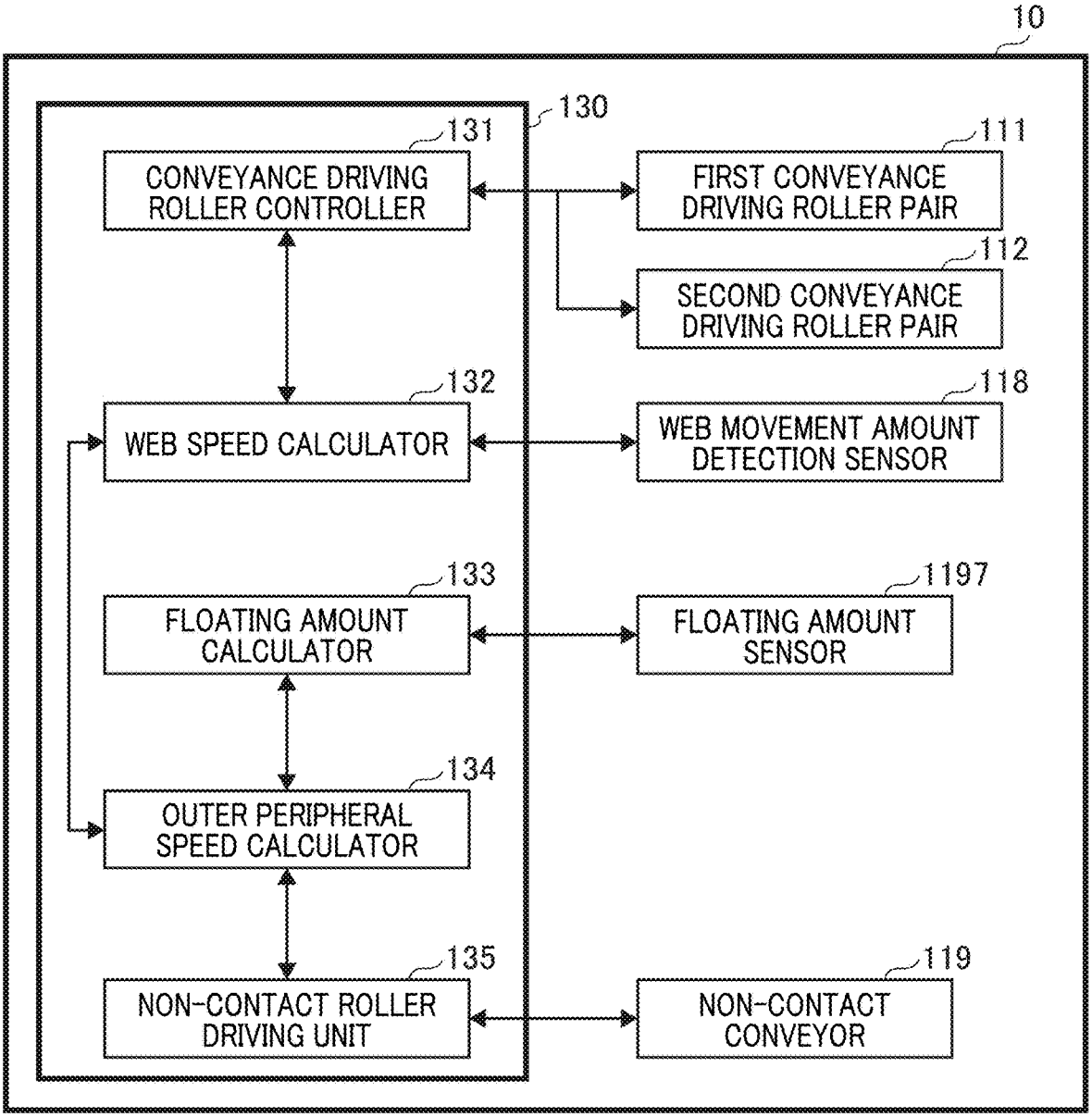
FIG. 4 is a block diagram illustrating a functional configuration of a web conveyance control device that is a conveyance control device according to an embodiment of the present disclosure.

Next, the conveyance control device according to an embodiment of the present disclosure will be described. FIG. 4 is a diagram illustrating a configuration of the web conveyance control device 10 according to the present embodiment. The web conveyance control device 10 includes at least the first conveyance driving roller pair 111 and the second conveyance driving roller pair 112, the web movement amount detection sensor 118, the floating amount detection sensor 1197, the non-contact conveyor 119, and the controller 130.

Further, the web conveyance control device 10 also includes functional blocks implemented by control programs executed on hardware resources of the controller 130. The controller 130 is hardware similar to an information processing device including a central processing unit (CPU) as an arithmetic processing device, a read-only memory (ROM) and a random access memory (RAM) as storage devices, which implements each of the functional blocks described below by executing the control programs.

The web conveyance control device 10 includes, in the controller 130, a conveyance driving roller controller 131, a web speed calculator 132, a floating amount calculator 133, an outer peripheral speed calculator 134, and a non-contact roller driving unit 135.

The conveyance driving roller controller 131 controls the rotation speeds of the first conveyance driving roller pair 111 and the second conveyance driving roller pair 112. The conveyance driving roller controller 131 determines the conveyance speed of the web W (the web speed Ws). The conveyance driving roller controller 131 controls the conveyance speed of the web W based on the result notified by the web speed calculator 132.

The web speed calculator 132 calculates the movement amount of the web W based on the result of detection by the web movement amount detection sensor 118, and calculates the conveyance speed of the web W based on the calculated movement amount. The web speed calculator 132 notifies the calculated web speed Ws to the conveyance driving roller controller 131 and the outer peripheral speed calculator 134.

The floating amount calculator 133 calculates the distance between the surface of the non-contact conveyance roller 1191 and the web W based on the result of detection by the floating amount detection sensor 1197. In other words, the value calculated here indicates the size of the air layer between the non-contact conveyance roller 1191 and the web W, the gap between the passing position of the web W and the non-contact conveyance roller 1191, or the like. The floating amount calculator 133 notifies the calculated value to the outer peripheral speed calculator 134.

The outer peripheral speed calculator 134 calculates a control value to set the outer peripheral speed AGs of the non-contact conveyance roller 1191 to a predetermined value based on the web speed Ws notified by the web speed calculator 132, the floating amount notified by the floating amount calculator 133, and the discharge timing for the IJ head device 117. The outer peripheral speed calculator 134 notifies the calculated control value to the non-contact roller driving unit 135. Further, the outer peripheral speed calculator 134 acquires the current outer peripheral speed AGs of the non-contact conveyance roller 1191 from the non-contact roller driving unit 135, calculates a control value for performing feedback control, and notifies the control value to the non-contact roller driving unit 135.

The non-contact roller driving unit 135 controls the outer peripheral speed AGs of the non-contact conveyance roller 1191 based on the control value notified by the outer peripheral speed calculator 134.

According to the thus configured web conveyance control device 10, it is possible to prevent image disturbance by the contact of the undried ink image with the non-contact conveyance roller 1191 and to suppress wear and deterioration of the components related to driving of the non-contact conveyance roller 1191. This makes it possible to suppress the cost of replacement parts and reduce downtime related to replacement of parts.

Figures 5A, 5B, 5C:
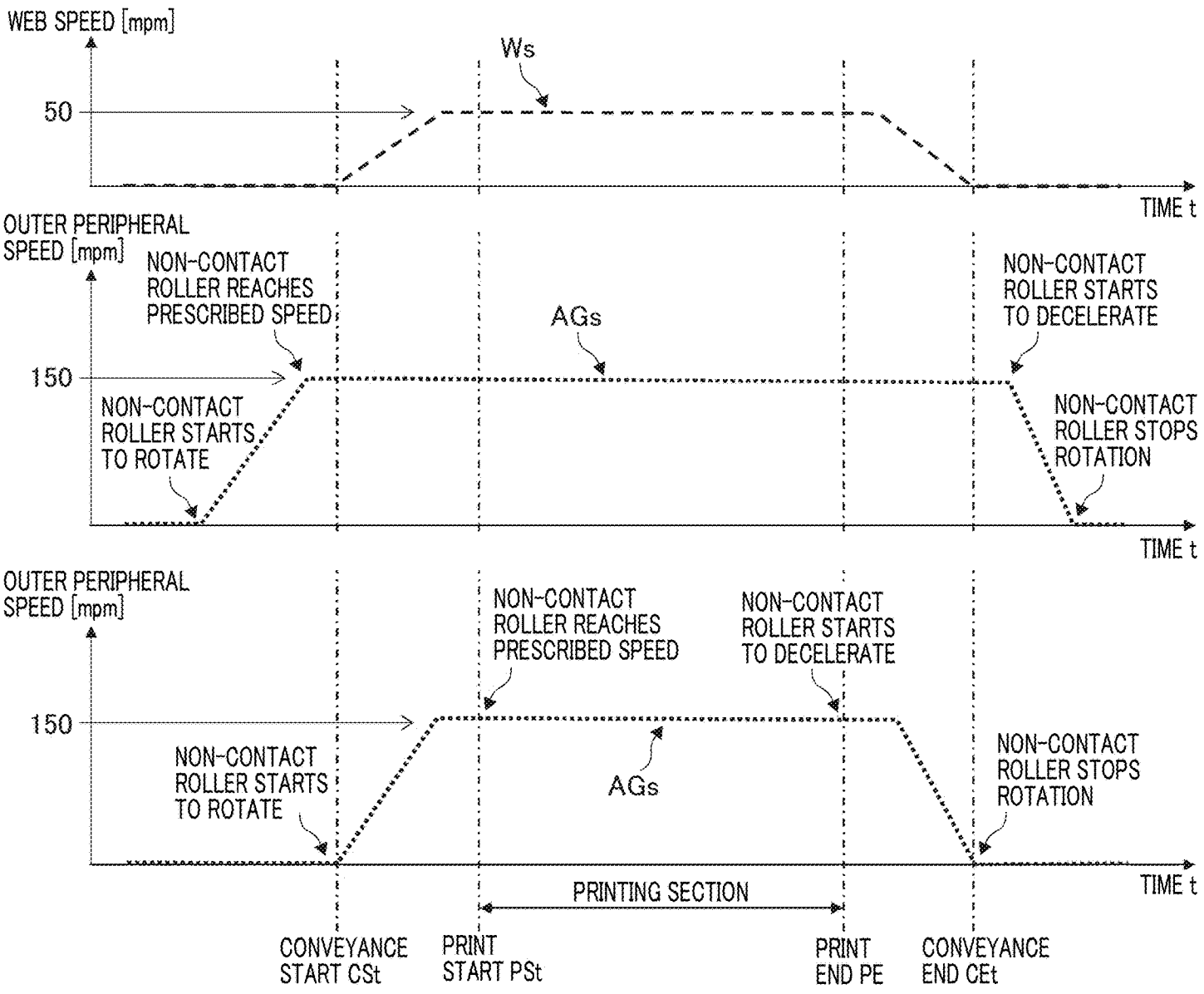
FIGS. 5A to 5C are timing charts illustrating an example of a control method of the web conveyance control device.

Example of Relationship Between Web Surface Speed and Non-Contact Roller Rotation Speed Next, control of the non-contact conveyance roller 1191 by the printer 100 and the web conveyance control device 10 will be described. FIGS. 5A to 5C are timing charts illustrating an example of the relationship between the web surface speed and the rotation speed of the non-contact conveyance roller 1191 (non-contact roller rotation speed) at the time of conveyance of the web W in a non-contact state. As described above, it is necessary to float the web W from the components of the conveyance path. Further, the "floating amount" needs to be appropriately controlled. In general, when the web W is conveyed at a high speed, surrounding air is taken into between the components (mainly rollers) of the conveyance path and the web W to form a gap between the web W and the roller surface. The amount (size) of the gap (air layer) is controlled by the relative relationship between the conveyance speed of the web W and the speed of the outer peripheral surface (peripheral speed) of the non-contact conveyance roller 1191 as described below.

The graphs in FIGS. 5A to 5C illustrates conditions on which it is possible to obtain the floating amount for forming the gap (air layer) between the web W and the non-contact conveyance roller 1191 that is arranged in a position where the undried image forming surface comes into contact. In FIGS. 5A to 5C, the speed of the outer peripheral surface (outer peripheral speed) of the non-contact conveyance roller 1191 for obtaining the floating amount with which the web W can be conveyed while maintaining the non-contact state between the web W and the non-contact conveyance roller 1191 is described as "outer peripheral speed AGs". Similarly, in FIGS. 5A to 5C, the web surface speed at which the floating amount is obtained is described as "web speed Ws".

FIG. 5A illustrates an example of time-series changes of the web speed Ws during the image forming operation. As illustrated in FIG. 5A, when the image forming process is started, the web W starts to be conveyed, the web speed Ws is accelerated, and after reaching 50 mpm, the liquid ink is discharged onto the web W passing below the IJ head device 117 to form an image. The web speed Ws is kept at 50 mpm in a printing section in which the image forming surface passes through the non-contact conveyance roller 1191. Then, at the end of the printing section, the web speed Ws decreases and finally becomes zero.

FIGS. 5B and 5C illustrate examples of changes in the outer peripheral speed AGs along with the changes in the web speed Ws as illustrated in FIG. 5A, that is, examples of rotation control of the non-contact conveyance roller 1191.

The example of FIG. 5B is in a case where the rotation of the non-contact conveyance roller 1191 is started before the image forming process is started and the conveyance of the web W is started. In this example, the controller 130 controls the rotation speed of the non-contact conveyance roller driving source 1193 so that the outer peripheral speed AGs of the non-contact conveyance roller 1191 reaches the prescribed speed of 150 mpm before the start of conveyance of the web W. Accordingly, the web W can be floated from the outer peripheral surface of the non-contact conveyance roller 1191 before the conveyance of the web W is started. This suppresses a difference in the path length between the start of conveyance of the web W and the printing process (during which the web W is being floated and conveyed).

In addition, the time required from the start of conveyance of the web W to the stabilization of conveyance of the web W (the conveyance amount of the web W) can be suppressed. This makes it possible to form a high-quality image at an early timing after the start of conveyance of the web W.

The example of FIG. 5C is in a case where the rotation of the non-contact conveyance roller 1191 is started at the same time when the image formation process is started and the conveyance of the web W is started. In this example, the controller 130 controls the rotation speed of the non-contact conveyance roller driving source 1193 so that the outer peripheral speed AGs reaches the prescribed speed of 150 mpm immediately before the printing section. Thus, the time for rotationally driving the non-contact conveyance roller 1191 can be shortened.

Therefore, the load applied to the components (the timing belt 1192 and the non-contact conveyance roller driving source 1193) related to the rotational driving of the non-contact conveyance roller 1191 can be suppressed. As a result, it is possible to suppress wear and deterioration of these components, thereby to reduce the cost of component replacement and the downtime caused by component replacement.

FIGS. 5A to 5C illustrate mere examples. In the present embodiment, there are conceivable various relationships among the timing at which the web W starts to be conveyed, the timing at which the web W reaches the printing speed (50 mpm), the timing at which the web W starts to decelerate, and the web W stops, the timing at which the non-contact conveyance roller 1191 starts to rotate, the timing at which the outer peripheral speed AGs of the non-contact conveyance roller 1191 reaches a prescribed speed (150 mpm), and the timing at which the rotation of the non-contact conveyance roller 1191 decelerates, and the timing at which the rotation of the non-contact conveyance roller 1191 stops.

Further, the printing speed (50 mpm) used in the above description is an example, and the printing speed is not limited to this. The printing speed is an image forming speed, which corresponds to the web speed Ws. Therefore, the conveyance driving roller controller 131 controls the web speed Ws by controlling the operations of the first conveyance driving roller pair 111 and the second conveyance driving roller pair 112 so that the relationship with the outer peripheral speed AGs in which the web W enters a non-contact conveyance state can be obtained. Similarly, the non-contact roller driving unit 135 controls the outer peripheral speed AGs by controlling the operations of the non-contact conveyance roller driving source 1193 so that the relationship with the web speed Ws in which the web W enters a non-contact conveyance state can be obtained.

The length of the conveyance path (path length) slightly changes between "when the web W is not floating" and "when the web W is floating". When the path length changes, the tension on the web W in the section also changes. Therefore, the controller 130 executes rotation amount control for controlling the rotation speed of the first driving roller 111*a* so that the predetermined tension is maintained and the conveyance of the web W is stabilized. A certain amount of time or a certain amount of conveyance is required until the rotation amount control is executed and the conveyance of the web W is stabilized.

Here, "the conveyance of the web W is stabilized" means that the conveyance speed of the web W is within predetermined upper and lower limit speeds, the tension of the web W is within the predetermined upper and lower limit tensions, and furthermore, the position and meandering speed of the web W as seen in the width direction are within predetermined values.

The controller 130 can perform a control to continue the rotation of the non-contact conveyance roller 1191 during a period from the end of a print job as one image forming process unit to the start of an image forming process for the next print job. This also minimizes the influence of path length changes during a print job.

In contrast to the printer 100 according to the present embodiment, in sonic of conventional printers, the positional relationship between the IJ head device 117 and the platen drum 116 in the image forming device 110 is different, or the platen drum 116 is not included. When the IJ head device 117 is disposed substantially parallel to the conveyance direction of the web W without the platen drum 116, the conveyance path passing through the IJ head device 117 to the drier 120 is substantially parallel. In this case, the web W can be conveyed until it enters the drier 120 without contacting the components constituting the conveyance path. In this case, it is not necessary to take measures as in the present embodiment.

Example of Detailed Configuration of Non-Contact Conveyor

Figure 6:
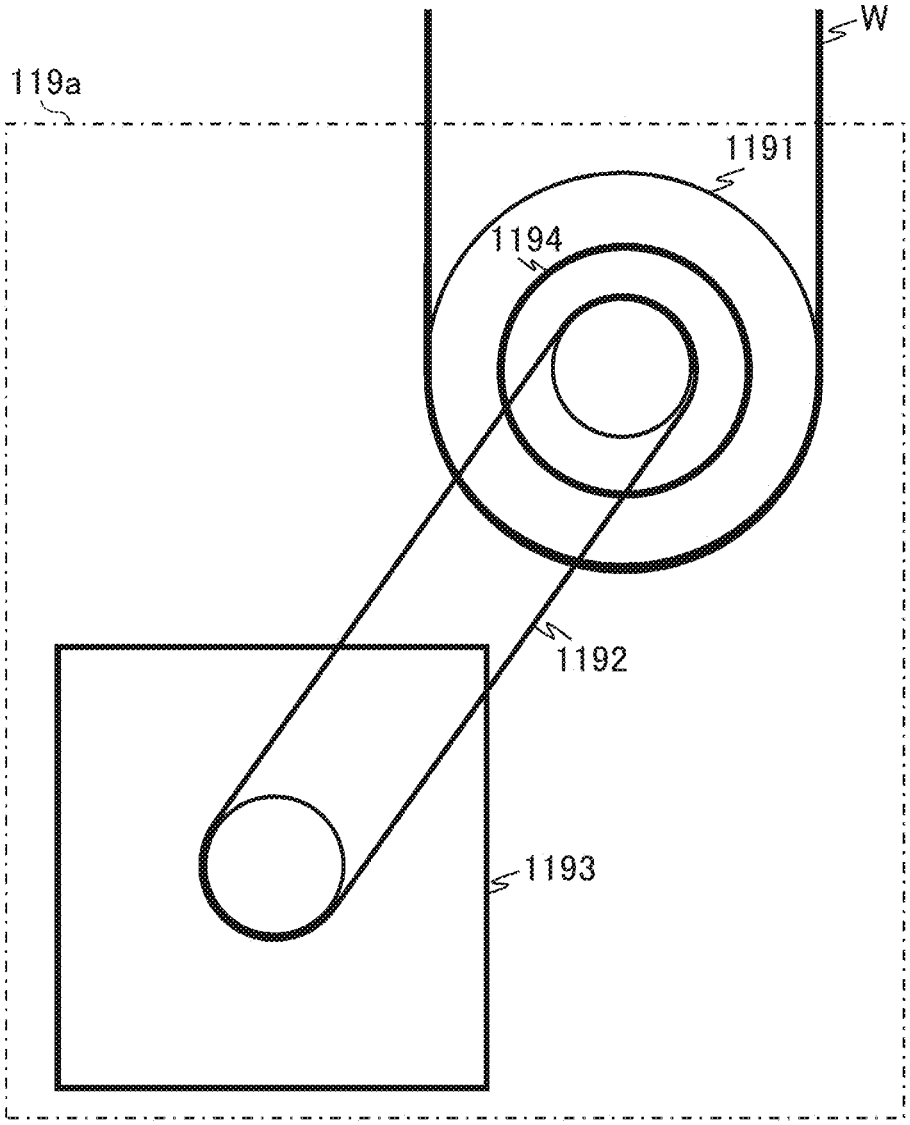
FIG. 6 is a diagram illustrating another configuration example of the non-contact conveyance controller according to the present embodiment.

Next, another example of the non-contact conveyor 119 will be described. The non-contact conveyor 119*a* will be described with reference to FIG. 6. As illustrated in FIG. 6, the non-contact conveyor 119*a* includes a non-contact conveyance roller 1191, a timing belt 1192, a non-contact conveyance roller driving source 1193, and an electromagnetic clutch 1194.

A rotation axis of the non-contact conveyance roller 1191 and a rotation axis of the non-contact conveyance roller driving source 1193 interlock with each other via a timing belt 1192 and an electromagnetic clutch 1194. Therefore, when the non-contact conveyance roller driving source 1193 operates to rotate the rotation axis, the timing belt 1192 turns to transmit motive power to the electromagnetic clutch 1194. If the electromagnetic clutch 1194 is "ON", this motive power is transmitted to the non-contact conveyance roller 1191. Thereby, the non-contact conveyance roller 1191 rotates.

When the electromagnetic clutch 1194 is "OFF", even if the timing belt 1192 turns, its motive power is not transmitted to the non-contact conveyance roller 1191. Therefore, the electromagnetic clutch 1194 constitutes a motive power connection switcher that switches the connection state between the non-contact conveyance roller driving source 1193 and the non-contact conveyance roller 1191.

When the electromagnetic clutch 1194 is "OFF", that is, when the motive power is cut off, the non-contact conveyance roller 1191 becomes a driven roller that rotates following the web W. In this case, it is possible to suppress wear and deterioration of components related to the rotational driving of the non-contact conveyance roller 1191. Therefore, it is possible to suppress replacement component costs and reduce downtime related to component replacement.

The connection/disconnection of the driving force can be switched by turning on/off the electromagnetic clutch 1194. However, the configuration for switching the connection/disconnection of the driving force is not limited to this.

The driving force is cut and the non-contact conveyance roller 1191 is driven to rotate following the web W when the web w is merely conveyed, not when a print job is executed, for example. The non-contact conveyance roller 1191 may be driven to rotate such that the non-contact conveyance roller 1191 is driven to rotate part of the process in which the conveyance speed of the web W reaches a prescribed speed at the execution of the print job, and then the driving force is provided to increase the outer peripheral speed AGs of the non-contact conveyance roller 1191 and reaches a prescribed speed before entry into the printing section.

Another Example of Relationship Between Web Surface Speed and Non-Contact Roller Rotation Speed Next, the outer peripheral speed AGs and the web speed Ws with respect to the "floating amount" when the web W is conveyed in a non-contact state will be described with FIGS. 7A to 7C.

Figures 7A, 7B, 7C:
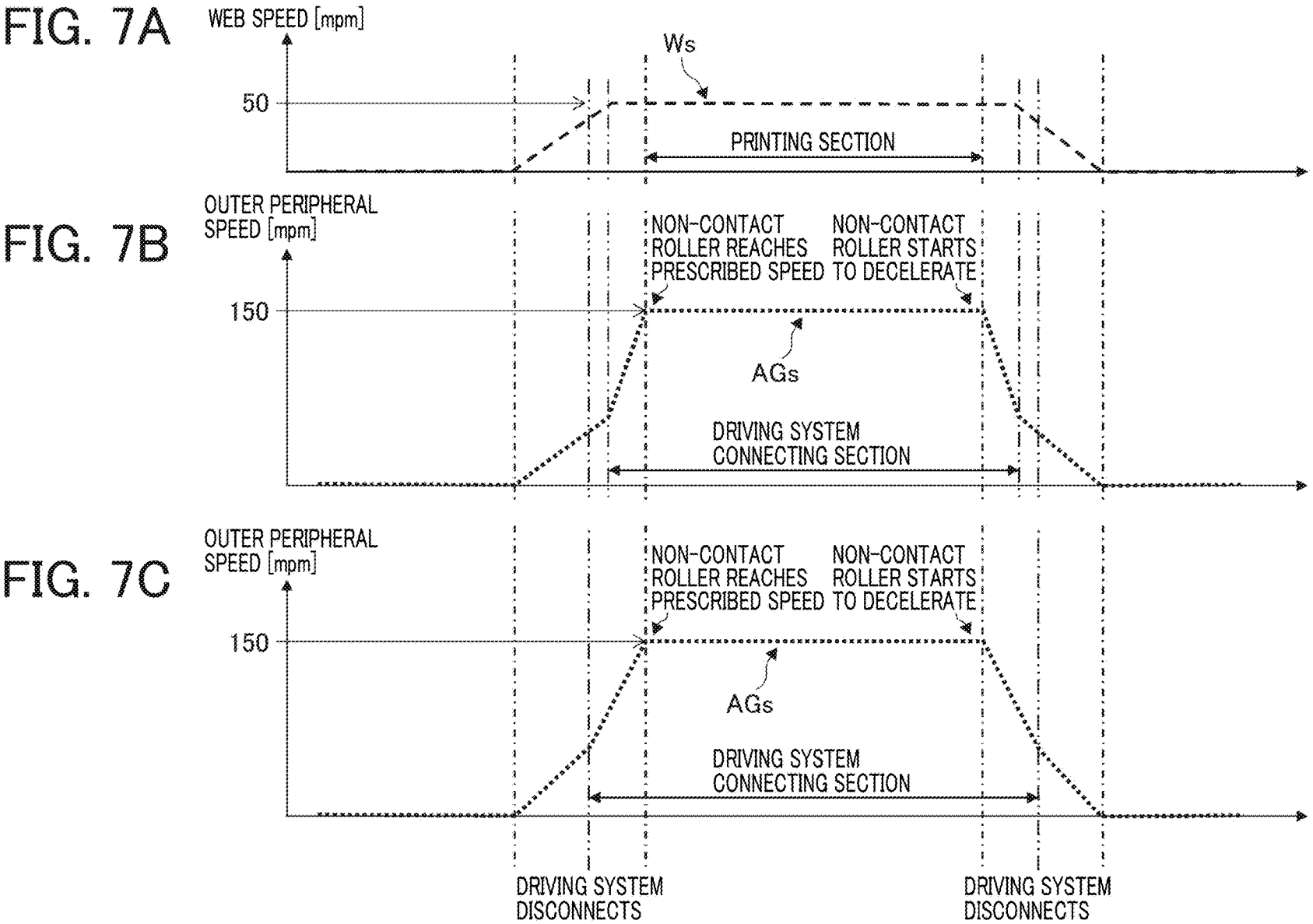
FIGS. 7A to 7C are timing charts illustrating another example of the control e of the web conveyance control device.

FIG. 7A is similar to FIG. 5A and illustrates an example of time-series changes of the web speed Ws during the image forming operation. As illustrated in FIG. 7A, when the image forming process is started, the web W starts to be conveyed, the web speed Ws is increased, and after reaching 50 mpm, the liquid ink is discharged onto the web W passing below the IJ head device 117 to form an image. The web speed Ws is kept at 50 mpm in a printing section in which the image forming surface passes through the non-contact conveyance roller 1191. Then, at the end of the printing section, the web speed Ws decreases and finally becomes zero.

FIGS. 7B and 7C illustrate examples of changes in the outer peripheral speed AGs along with the changes in the web speed Ws as illustrated in FIG. 7A, that is, examples of rotation control of the non-contact conveyance roller 1191.

First, FIG. 7B illustrates an example in which the electromagnetic clutch 1194 is OFF when the image forming process is started and the conveyance of the web W is started. In this example, when the web speed Ws increases, the outer peripheral speed AGs of the non-contact conveyance roller 1191 that rotates following the conveyance of the web W also increases. Then, when entering the printing section, the electromagnetic clutch 1194 is turned on to transmit the driving force of the non-contact conveyance roller driving source 1193 to the non-contact conveyance roller 1191. Thus, the outer peripheral speed AGs of the non-contact conveyance roller 1191 reaches the predetermined speed of 150 mpm.

As illustrated in the example of FIG. 7C, when the image forming process is started and the conveyance of the web W is started, the electromagnetic clutch 1194 can be turned off so that the web speed Ws increases and the outer peripheral speed AGs of the non-contact conveyance roller 1191 increases. Then, the drive system can be turned on just before entry into the printing section.

As described above, from the start of conveyance of the web W, the non-contact conveyance roller 1191 is caused to follow the web W until a certain speed is reached without the driving force, and then is controlled to connect to the drive system so that the outer peripheral speed AGs reaches the prescribed speed. Thereby, the deterioration of the components of the drive system can be effectively suppressed.

Second Embodiment of Image Forming Apparatus

Figure 8:
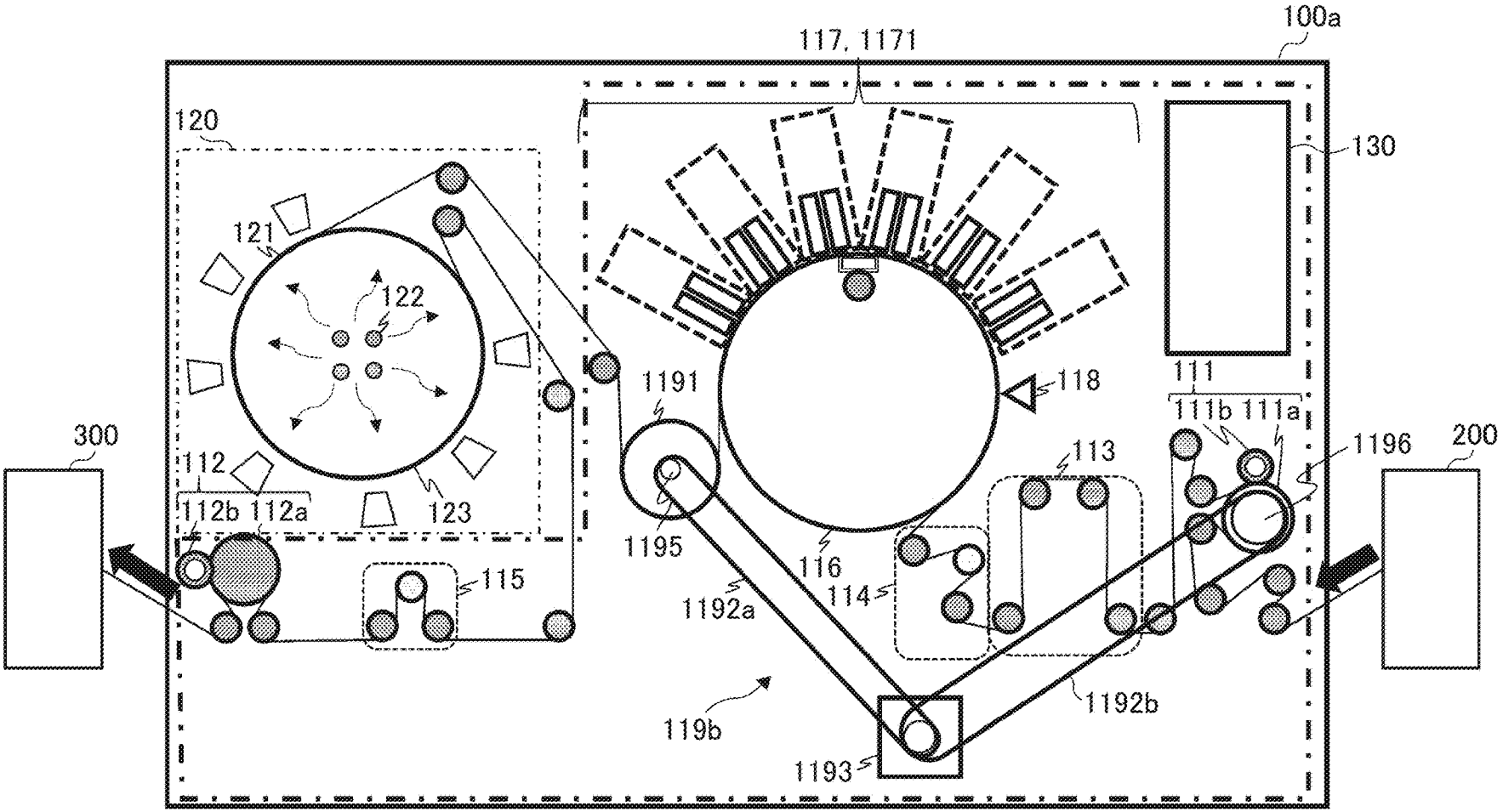
FIG. 8 is a configuration diagram illustrating another example of a printer that is the image forming apparatus according to an embodiment of the present disclosure.

The conveyance control device and the image forming apparatus according to another embodiment of the present disclosure are described below with reference to FIG. 8. A printer 100*b* according to the present embodiment has the same configuration as the printer 100 described above, but differs in including a non-contact conveyor 119*b* instead of the non-contact conveyor 119. Therefore, the non-contact conveyor 119*b* will be described below in detail.

The non-contact conveyor 119*b* is configured such that motive power of a non-contact conveyance roller driving source 1193 is shared by a first driving roller 111*a* and a non-contact conveyance roller 1191. A first timing pulley 1195 is attached to a rotation shaft of the non-contact conveyance roller 1191. A first timing belt 1192*a* is wound around the first timing pulley 1195 and the non-contact conveyance roller driving source 1193. A second timing pulley 1196 is attached to a rotation shaft of the first driving roller 111*a*, and a second timing belt 1192*b* is wound around the second timing pulley 1196 and the non-contact conveyance roller driving source 1193.

A conveyance speed of the web W (web speed Ws) substantially matches an outer peripheral speed of the first driving roller 111*a*. Therefore, in order to rotate the non-contact conveyance roller 1191 at the outer peripheral speed AGs for forming a conveyance path while maintaining a non-contact state between the non-contact conveyance roller 1191 and the web W, the speed reduction ratio of connection with the non-contact conveyance roller driving source 1193 needs to be changed.

Therefore, the non-contact conveyor 119*b* is configured such that the first timing pulley 1195 determining the rotation speed of the non-contact conveyance roller 1191 is smaller in diameter (the number of teeth) than the second timing pulley 1196 determining the rotation speed of the first driving roller 111*a*, and the outer peripheral speed AGs of the non-contact conveyance roller 1191 is faster than the outer peripheral speed (≈the web speed Ws) of the first driving roller 111*a*.

According to the above-described configuration, it is assumed that the web speed Ws and the outer peripheral speed AGs are controlled to obtain the relationship described with reference to FIGS. 5A to 5C, for example. In this case, when the web speed Ws is 50 mpm and the outer peripheral speed AGs is 150 mpm, the ratio in diameter between the first timing pulley 1195 and the second timing pulley 1196 can be determined to satisfy "Ws: AGs=1:3".

According to the above-described configuration, the number of components constituting the conveyance control device can be reduced, thereby achieving improvement in reliability and cost reduction. The unit for connecting the drive system of the shared driving source (the non-contact conveyance roller driving source 1193) and the component for setting the speed reduction ratio to a desired value are not limited to the above-described configuration.

The component sharing the driving source with the non-contact conveyance roller 1191 is not limited to the first driving roller 111*a* but may be any driving roller that is in charge of conveying the web W. For example, a driving source of the second driving roller 112*a* can be used.

When the drying drum 121 has a function of conveying the web W, a driving source that can rotationally drive the second driving roller 112*a* such that the outer peripheral speed of the drying drum 121 substantially matches the web speed Ws may be provided and shared. Whichever driving source is shared, the driving source sets the speed reduction ratio such that the relationship between the web speed Ws and the outer peripheral speed AGs becomes the relationship described above.

Further, the driving source is not limited to a driving roller in charge of conveying the web W but any driving source that drives at a substantially constant relative ratio to the conveyance speed of the web W (the web speed Ws) in a printing section defined by a print job could makes it possible to obtain the same advantageous effect by sharing with the non-contact conveyance roller 1191.

Further, as long as the web speed Ws can be set in the print job, a plurality of speed reduction ratios corresponding to the setting of the web speed Ws may be set in a switchable manner in addition to the speed reduction ratio exemplified above. In this case, the controller 130 can change the setting of the web speed Ws and the setting of the reduction ratios.

Here, description will be given as to a case in which it is possible to select a plurality of relationships between the conveyance speed (the web speed Ws) of the web W at which the non-contact conveyance roller 1191 is in a non-contact state and the outer peripheral speed AGs of the non-contact conveyance roller 1191. For example, if "Ws=100 mpm, AGs=100 mpm", the speed reduction ratio can be set to "1:1". If "Ws=50 mpm, AGs=150 mpm", the speed reduction ratio can be set to "1:3". If "Ws=25 mpm, AGs=175 mpm", the speed reduction ratio can be set to "1:7".

In a case of adopting a configuration in which the speed reduction ratio is set to "1:1", the electromagnetic clutch 1194 may be used as in the non-contact conveyor 119*a* described above with reference to FIG. 6 to switch between connection and disconnection of the drive system so that the non-contact conveyance roller 1191 can rotate following the web W.

In the present embodiment, the arrangement of the non-contact conveyance roller 1191 has been described taking the section between the platen drum 116 having the undried ink image and the drying drum 121 as an example, but is not limited to this. For example, downstream of the drying drum 121, if the pressure at which the image forming surface comes into contact with the components constituting the conveyance path is large, the image forming surface may be disturbed if the drying is insufficient. Therefore, the same advantageous effects can be obtained by arranging a component similar to the non-contact conveyor 119 at a position downstream of the drying drum 121 where there is a roller to contact the image forming surface.

The printer 100 and the web conveyance control device 10 according to the present embodiment have the conveyance roller that is capable of controlling the operations of a conveyance component that may pass through the image forming surface in an insufficiently dried state as described above and is capable of supporting the web W in a non-contact manner. When supporting the image forming surface that is not sufficiently dried, the high-speed rotation of the conveyance roller is properly controlled to intentionally take in air between the outer peripheral surface of the roller and the web W so that the web W is floated from the outer peripheral surface of the roller. Thus, it is possible to avoid a decrease in reliability due to the use of a large number of components for conveying the web W in a non-contact manner, and to suppress upsizing of the apparatus. Further, it is possible to suppress cost increase.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A conveyance control device configured to control conveyance of a sheet-shaped recording medium onto which a liquid is discharged by a liquid discharge device, the conveyance control device comprising:

a conveyance driving roller configured to control a conveyance speed of the sheet-shaped recording medium;

a non-contact conveyor including a non-contact conveyance roller that constitutes part of a conveyance path of the recording medium, the non-contact conveyance roller having an outer peripheral surface in a non-contact state with the sheet-shaped recording medium during conveyance of the sheet-shaped recording medium; and processing circuitry configured to control at least one of an operation of the conveyance driving roller and an operation of the non-contact conveyance roller so that a speed of the outer peripheral surface of the non-contact conveyance roller becomes a speed relatively faster than the conveyance speed of the sheet-shaped recording medium, wherein the processing circuitry is configured to control at least one of an operation of the conveyance driving roller and an operation of the non-contact conveyance roller so that the speed of the outer peripheral surface of the non-contact conveyance roller becomes the speed relatively faster than the conveyance speed of the sheet-shaped recording medium, upon a conveyance speed of the sheet-shaped recording medium being below a threshold speed.

2. The conveyance control device according to claim 1, wherein the processing circuitry is configured to operate the non-contact conveyance roller before a start of the conveyance of the sheet-shaped recording medium.

3. The conveyance control device according to claim 1, wherein, before a part of the sheet-shaped recording medium having passed the liquid discharge device reaches a position of the outer peripheral surface of the non-contact conveyance roller, the processing circuitry is configured to operate the non-contact conveyance roller such that the speed of the outer peripheral surface of the non-contact conveyance roller becomes the speed relatively faster than the conveyance speed of the sheet-shaped recording medium.

4. The conveyance control device according to claim 3, wherein, after the part of the sheet-shaped recording medium passes the non-contact conveyance roller, the processing circuitry is configured to operate the non-contact conveyance roller at a speed relatively slower than the conveyance speed of the sheet-shaped recording medium.

5. The conveyance control device according to claim 1, wherein, after a stop of the conveyance of the sheet-shaped recording medium, the processing circuitry is configured to stop operation of the non-contact conveyor.

6. The conveyance control device according to claim 1, wherein the non-contact conveyor includes:

the non-contact conveyance roller;

a timing belt configured to transmit motive power to the non-contact conveyance roller; and a motive power source configured to supply the motive power transmitted via the timing belt, and wherein the processing circuitry is configured to control the motive power source to control the speed of the outer peripheral surface of the non-contact conveyance roller.

7. The conveyance control device according to claim 6, wherein the motive power source is configured to supply the motive power to the non-contact conveyance roller and the conveyance driving roller.

8. The conveyance control device according to claim 7, wherein the non-contact conveyor includes a motive power connection switcher configured to switch connection and disconnection of the motive power to the non-contact conveyance roller.

9. An image forming apparatus comprising:

the conveyance control device according to claim 8 configured to control the conveyance of the sheet-shaped recording medium; and the liquid discharge device configured to discharge the liquid onto the sheet-shaped recording medium conveyed by the conveyance control device, to form an image on the sheet-shaped recording medium.

10. The conveyance control device according to claim 1, further comprising a sensor configured to detect a gap between the outer peripheral surface of the non-contact conveyance roller and the sheet-shaped recording medium passing the non-contact conveyance roller, wherein the processing circuitry is configured to control a rotation speed of the non-contact conveyance roller based on the gap detected by the sensor.

11. An image forming apparatus comprising:

the conveyance control device according to claim 1 configured to control the conveyance of the sheet-shaped recording medium; and the liquid discharge device configured to discharge the liquid onto the sheet-shaped recording medium conveyed by the conveyance control device, to form an image on the sheet-shaped recording medium.

* * * * *